US009057231B2

(12) United States Patent
Barnhart et al.

(10) Patent No.: US 9,057,231 B2
(45) Date of Patent: Jun. 16, 2015

(54) ENERGIZING RING DIVOT BACK-OUT LOCK

(75) Inventors: Daniel R. Barnhart, Houston, TX (US); Nicholas P. Gette, Houston, TX (US); Baozhi Zhu, Houston, TX (US); Jeffrey A. Raynal, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 327 days.

(21) Appl. No.: 13/614,525

(22) Filed: Sep. 13, 2012

(65) Prior Publication Data

US 2014/0069646 A1 Mar. 13, 2014

(51) Int. Cl.

| | |
|---|---|
| ***E21B 33/03*** | (2006.01) |
| ***E21B 33/04*** | (2006.01) |
| ***E21B 23/00*** | (2006.01) |
| ***E21B 33/12*** | (2006.01) |
| *E21B 33/00* | (2006.01) |

(52) U.S. Cl.

CPC ..... *E21B 23/00* (2013.01); *E21B 2033/005* (2013.01); *E21B 33/03* (2013.01); *E21B 33/1208* (2013.01); *E21B 33/04* (2013.01)

(58) Field of Classification Search

USPC ..... 277/328; 166/217, 208, 382

See application file for complete search history.

(56) References Cited

U.S. PATENT DOCUMENTS

| | | | | |
|---|---|---|---|---|
| 4,949,787 | A | 8/1990 | Brammer et al. | |
| 5,060,724 | A * | 10/1991 | Brammer et al. | 166/208 |
| 5,285,853 | A | 2/1994 | Eckert et al. | |
| 5,307,879 | A | 5/1994 | Kent | |
| 5,327,965 | A | 7/1994 | Stephen et al. | |
| 5,360,063 | A | 11/1994 | Henderson, Jr. | |
| 5,372,201 | A | 12/1994 | Milberger | |
| 5,450,905 | A | 9/1995 | Brammer et al. | |
| 5,456,314 | A * | 10/1995 | Boehm et al. | 166/208 |
| 5,725,056 | A | 3/1998 | Thomson | |
| 5,997,003 | A * | 12/1999 | Turner | 277/339 |
| 7,559,366 | B2 | 7/2009 | Hunter et al. | |
| 7,614,447 | B2 * | 11/2009 | Jennings | 166/84.1 |
| 7,762,319 | B2 | 7/2010 | Nelson | |
| 7,819,182 | B2 | 10/2010 | Adamek | |
| 8,006,764 | B2 | 8/2011 | Adamek et al. | |
| 8,061,428 | B2 | 11/2011 | Fenton et al. | |
| 8,127,857 | B2 | 3/2012 | Sinnott et al. | |
| 8,146,670 | B2 | 4/2012 | Ellis et al. | |
| 8,171,996 | B2 | 5/2012 | Jennings | |
| 8,186,426 | B2 | 5/2012 | Nelson | |
| 8,205,670 | B2 | 6/2012 | Nelson | |
| 8,312,922 | B2 | 11/2012 | Nelson | |
| 8,322,428 | B2 | 12/2012 | Jennings | |

OTHER PUBLICATIONS

International Search Report and Written Opinion issued in connection with corresponding Application No. PCT/US2013/058988 on Sep. 29, 2014.

* cited by examiner

*Primary Examiner* — Giovanna C Wright

(74) *Attorney, Agent, or Firm* — Bracewell & Giuliani LLP

(57) ABSTRACT

An energizing ring can be used to energize a seal. In embodiments, the energizing ring has a recess, or divot, adjacent to a portion of the seal so that if the seal is deformed during a balloon-type failure, a portion of the deformed seal can occupy the recess. The seal, thus, engages surfaces of the recess to prevent axial movement of the energizing ring relative to the seal.

19 Claims, 3 Drawing Sheets

ENERGIZING RING DIVOT BACK-OUT LOCK

BACKGROUND OF THE INVENTION

1. Field of the Invention

The present invention relates in general to mineral recovery wells, and in particular to lockdown rings for retaining wellbore members in a housing.

2. Brief Description of Related Art

In wellheads used for recovery of minerals, such as hydrocarbons, it is common to land a tubing hanger in the wellhead housing. An annular seal is usually inserted in the annulus between the wellhead housing and the tubing hanger for the purpose of sealing the annulus, thus preventing fluids from escaping the annulus toward the wellhead. With some types of seals, an energizing ring is urged against the seal to cause the seal to expand and sealingly engage an adjacent surface. With a u-shaped seal, for example, an energizing ring can be forced into the gap between the legs of the u-shaped seal to urge the legs outward and engage the inner diameter of the wellhead housing and the outer diameter of the tubing hanger.

During wellbore operations, high pressure conditions can occur. The high pressure can exert upward force on the tubing hanger. Significant force can urge the tubing hanger upward from its position in the wellhead housing. The energized seal can help hold the tubing hanger in position. Unfortunately, the force and positional shifting of the tubing hanger can urge the energizing ring upward, away from its position within the sealing ring. Once the energizing ring has shifted to the point that the seal is no longer energized, the seal can fail and allow further movement of the tubing hanger relative to the casing hanger. Such a failure can be catastrophic. It is desirable to hold the energizing ring in position within the sealing ring so that the energizing ring cannot shift in response to upward force on the tubing hanger.

SUMMARY OF THE INVENTION

Embodiments of the claimed invention include an energizing ring having a feature to lock the energizing ring in place if a ballooning failure begins to occur on the metal seal that is energized by the energizing ring. The feature uses the ballooning failure of the seal to create an interference lock on the energizing ring. In embodiments, the lock feature includes a divot, or annular recess, on the energizing ring. During a balloon type failure, the ballooning material fills the divot. The material in the divot, being monolithic with the rest of the seal, can increase the force required to pull or push the energizing ring out of the set position. The lock can be disengaged by destructively pulling the energizing ring from the seal ring pocket. Otherwise, the lock will stay engaged after ballooning occurs. Embodiments are not limited to seal ring and energizing ring combinations. Embodiments can include other adjacent surfaces such as, for example, a pin and box type tubing connector when the pin, under some circumstances, can have a balloon or mushroom type expansion during a failure.

Embodiments of a seal locking assembly include an annular seal, an energizing ring having a nose and a sidewall, the sidewall having a forcing surface for urging at least a portion of the annular seal against a sealing surface when the energizing ring is positioned axially adjacent to the annular seal, and an annular recess located on the sidewall below the forcing surface. In embodiments, the annular seal is deformable from a first shape to a second shape in response to force exerted against the annular seal, with at least a portion of the annular seal occupying the recess when the annular seal is in the second shape.

In embodiments of the seal locking assembly, the second shape creates an interference lock that prevents axial movement of the energizing ring relative to the annular seal in at least one axial direction. In embodiments, the interference lock prevents axial can movement of the energizing ring relative to the annular seal in both axial directions.

In embodiments of the seal locking assembly the annular seal includes a u-shaped seal having an inner leg and an outer leg defining a gap therebetween, and upon occupying the gap, the energizing ring can urge the inner and outer legs into sealing engagement with the sealing surface and with another sealing surface, respectively.

In embodiments, the annular recess comprises an outward and upward facing tapered surface. In embodiments, the second shape of the annular seal can engage the outward and upward facing tapered surface. In embodiments of the seal locking assembly, once the annular seal has assumed the second shape, the energizing ring can be disengaged only by deformation of one of the energizing ring and the annular seal.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
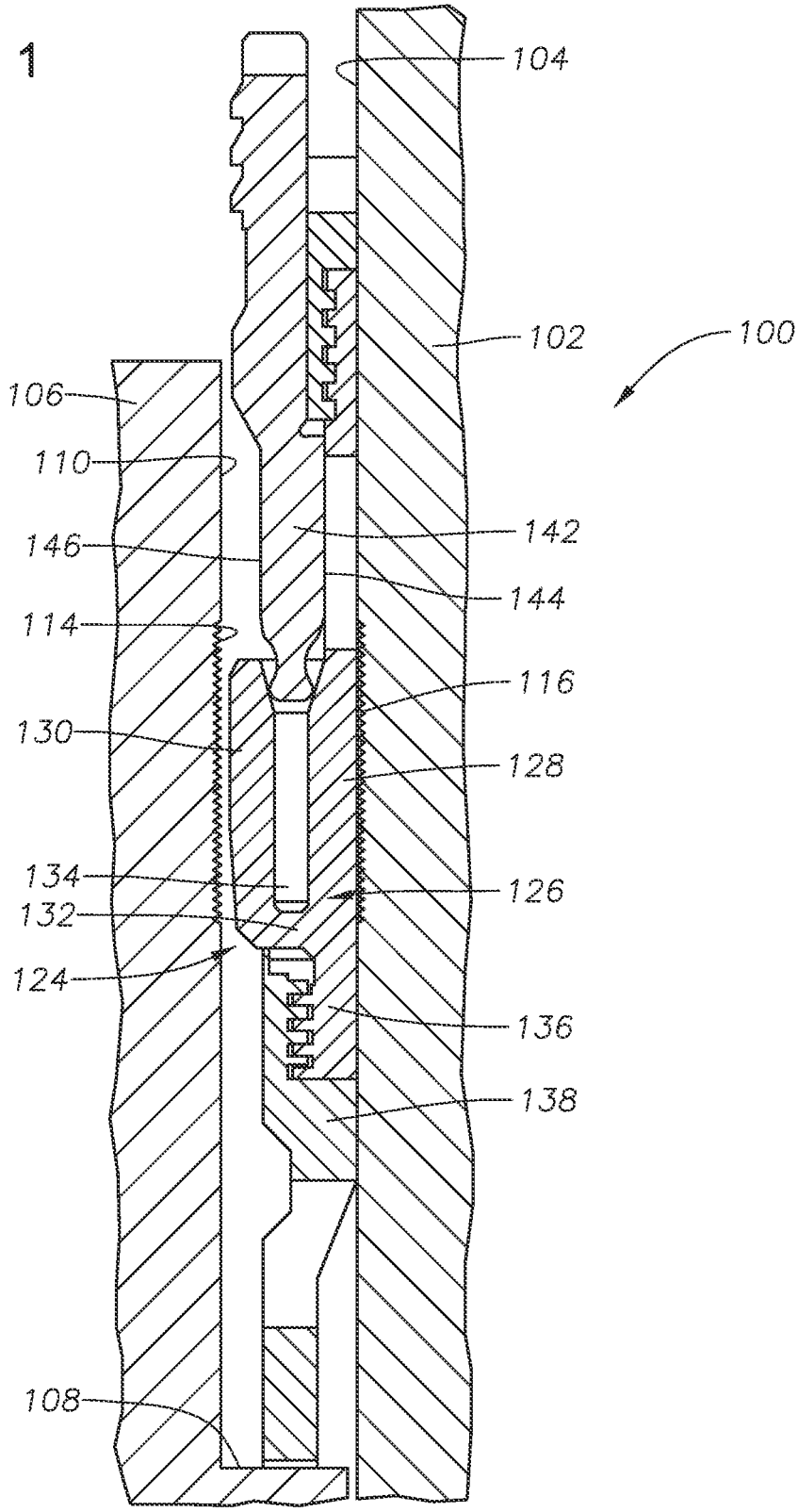
FIG. 1 is a sectional side view of a wellhead housing with an embodiment of an energizing ring divot backout lock.

Referring to FIG. 1, an energizing ring divot backout lock 100 is presented. In the illustrated embodiment, the divot backout lock 100 is shown as a part of wellhead housing 102.

Wellhead housing 102 can be a conventional high pressure housing for a subsea well. It is a large tubular member located at the upper end of a well, such as a subsea well. Wellhead housing 102 has an axial bore 104 extending through it. A casing hanger 106 is shown landed in the wellhead housing 102. Casing hanger 106 is a tubular conduit secured to the upper end of a string of casing (not shown). Casing hanger 106 has an upward facing shoulder 108 on its exterior. The exterior wall 110 of casing hanger 106 is generally parallel to the wall of bore 104 but spaced inwardly. This results in an annular pocket 112, or clearance, between casing hanger exterior wall 110 and bore 104. Sealing surface 114 is located on an outer diameter of casing hanger 106. Sealing surface 116 is located on an inner diameter of wellhead housing 102. Sealing surfaces 114, 116 can be generally smooth, or can have features to promote sealing engagement such as, for example wickers. As one of skill in the art will appreciate, wickers are circumferential, parallel ridges on a surface, defining grooves therebetween.

A seal assembly 124 is shown landed in the pocket between casing hanger exterior wall 110 and bore wall 104. Seal assembly 124 can be a metal seal, made up entirely or substantially of metal components. These components may include a generally U-shaped seal member 126. Seal member 126 has an outer wall or leg 128 and a parallel inner wall or leg 130, the legs 128, 130 being connected together at the bottom by a base 132 and open at the top. The inner diameter of outer leg 128 is radially spaced outward from the outer diameter of inner leg 130. This results in an annular clearance 134 between legs 128, 130. The inner diameter of inner leg 130 and the outer diameter of outer leg 128 are smooth, cylindrical, parallel surfaces.

In embodiments, tab 136 extends downward from base 132. Tab 136 can be used, for example, to support spacer ring 138, as shown in FIG. 1. Spacer ring 138 lands on shoulder 108 to prevent further downward movement of seal assembly 124. In embodiments, spacer ring 138 is not used and tab 136 can land on shoulder 108. In embodiments, neither tab 136 or spacer ring 138 are used, in which case base 132 can land on shoulder 108. In embodiments, any of base 132, tab 136, or spacer ring 138 can land on other surfaces or features to prevent further downward movement on seal assembly 124.

Still referring to FIG. 1, an example of an energizing ring 142 is shown employed to force legs 128, 130 radially apart from each other and into sealing engagement with sealing surfaces 114, 116. The sealing surfaces 114, 116 sealingly engage inner leg 128 and outer leg 130, respectively, of the seal assembly 124 as the energizing ring 142 forces the legs 128, 130 against sealing surfaces 114, 116. Energizing ring 142 has an outer diameter engaging surface 144 that frictionally engages the inner diameter of outer leg 128. Energizing ring 142 has an inner diameter engaging surface 146 that frictionally engages the outer diameter of inner leg 130. The radial thickness of energizing ring 142, between engaging surfaces 144, 146, is greater than the initial radial dimension of the clearance 134.

Figure 2:
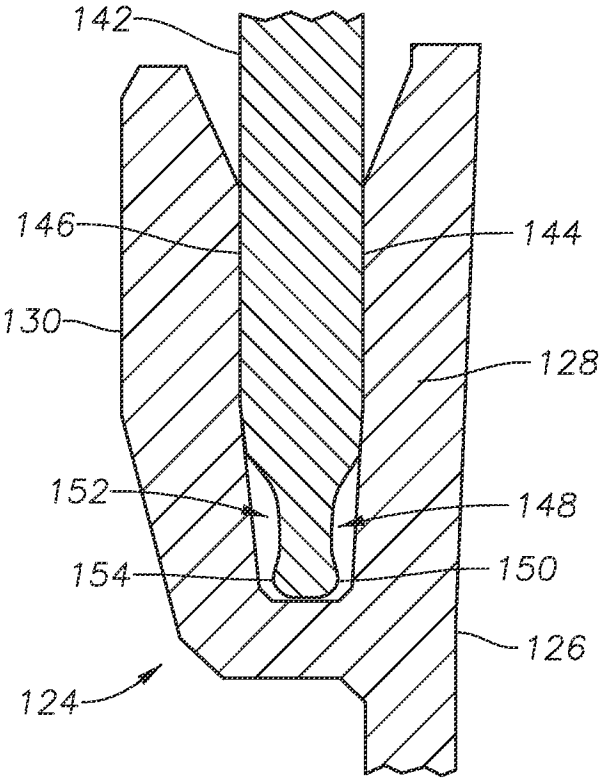
FIG. 2 is a sectional side view of a seal in an energized state with the energizing ring of FIG. 1.

Referring now to FIG. 2, energizing ring 142 has a divot, or recess 148, on an outer diameter surface. In embodiments, recess 148 can be located below engaging surface 144 and proximate a lower terminal end of energizing ring 142. Recess 148 has a smaller outer diameter than other portions of energizing ring 142. Recess 148 can also include shoulder 150, which is an upward and outward facing shoulder located below the deeper portions of recess 148. Shoulder 150 has an outer diameter that is greater than the outer diameter of other portions of recess 148. Moving upward from recess 148, the outer diameter becomes larger as recess 148 transitions outward toward outer diameter ("OD") engaging surface 144.

In embodiments, inner diameter ("ID") recess 152 can be located on an inner diameter surface of energizing ring 142. Recess 152 has a greater inner diameter than other portions of energizing ring 142. Recess 152 also includes shoulder 154, which is an upward and inward facing shoulder located below the deeper portions of recess 152. Shoulder 154 has an inner diameter that is less than the inner diameter of other portions of recess 152. Moving upward from recess 152, the inner diameter becomes smaller as recess 152 transitions inward toward ID engaging surface 146.

Still referring to FIG. 2, seal assembly 124 is shown in an energized state, with energizing ring 142 fully inserted into u-shaped seal member 126. The energized state, as shown in FIG. 2, is a first shape of seal member 126, wherein the inner and outer legs 130, 128 are urged outward to sealingly engage sealing surfaces 114, 116 (FIG. 1), but seal member 126 is not otherwise deformed.

Figure 3:
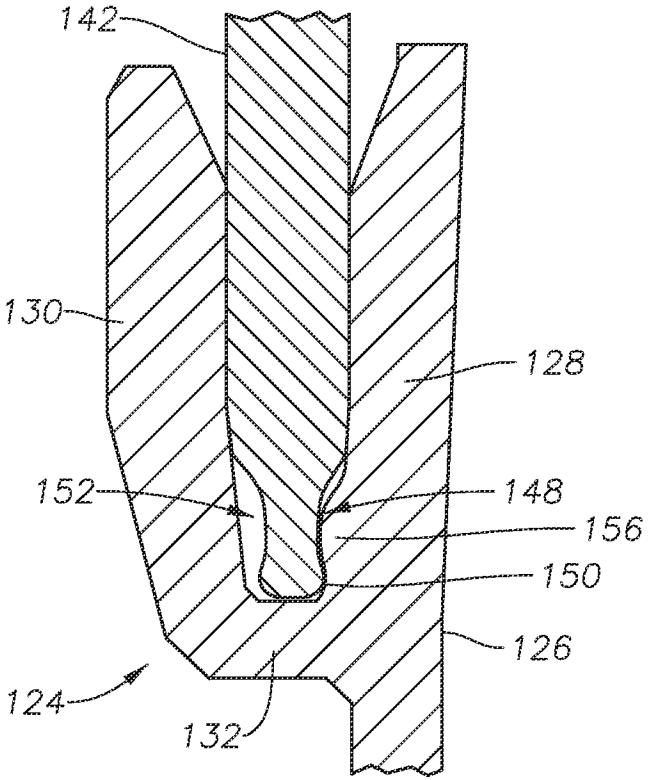
FIG. 3 is a sectional side view of the seal and energizing ring of FIG. 2, after the seal experiences a balloon-type failure.

Referring to FIG. 3, seal assembly 124 is shown in the energized state and after having been deformed from the first shape (FIG. 2) to a second shape. Such deformation can occur, for example, when forces such as pressure cause upward thrust of casing hanger 106 (FIG. 1). Upward movement of casing hanger 106 exerts pressure against seal member 126, which can cause seal member 126 to yield. With sufficient upward thrust force exerted on seal member 126 by casing hanger 106, seal member 126 can undergo a "balloon" failure. A balloon failure occurs when seal member 126 is deformed to the point of ballooning from the first shape to the second shape. In embodiments, base 132 can shift upward and the inner diameter of outer leg 128 can expand inwardly, such that the inner diameter becomes smaller. In embodiments, inner leg 130 yields due to upward force from casing hanger 106, thus causing the outer diameter of inner leg 130 to expand outward.

The area of seal member 126 that expands or shifts toward energizing ring 142 is identified as balloon 156. In embodiments, balloon 156 expands to fully or partially fill recess 148 or recess 152. When in the second shape, at least a portion of balloon 156 can engage shoulder 150 to create an interference lock between seal member 126 and energizing ring 142. When seal member 126 is in the second shape, such that a portion balloon 156 is in recess 148 and, thus, above shoulder 150, balloon 156 can prevent energizing ring 142 from moving axially upward. In embodiments, shoulder 150 contacts balloon 156, and thus shoulder 150 cannot move relative to balloon 156. Seal member 126 remains sealing engaged to wellhead housing 102, thus limiting axial movement of seal member 126. Therefore balloon 156, being a part of seal member 126, prevents or reduces upward movement of energizing ring 142. In embodiments having recess 152 on an ID surface of energizing ring 142, a seal member balloon that expands into recess 152 can prevent upward movement of energizing ring 142 when, for example, the balloon engages shoulder 154.

Once balloon 156 has expanded into recess 148 or recess 152, energizing ring 142 is restrained from upward movement relative to seal member 126 unless energizing ring 142 is destructively pulled from annular clearance 134. In embodiments, to remove energizing ring 142 after balloon 156 has engaged recess 148, seal member 126 is further deformed or energizing ring 142 is deformed. For example, to withdraw energizing ring 142 after seal member 126 has assumed the second shape, energizing ring 142 is pulled upward with sufficient force to cause balloon 156 to deform away from recess 148, thus permitting shoulder 150 to move past balloon 156.

Embodiments are not limited to seal ring and energizing ring combinations. Embodiments can include other adjacent surfaces wherein one of the surfaces is subject to expansion during failure, as a balloon or mushroom type failure. In embodiments, for example, a pin and box type tubing connector can use a divot backout lock when the pin, under some circumstances, can show a balloon or mushroom type expansion during a failure. In such embodiments (not shown), a divot, or recess, can be present on an inner diameter of the box and the pin can, during a balloon type failure, expand to fill at least a portion of the divot, thus locking the connection between the pin and the box.

Figure 4:
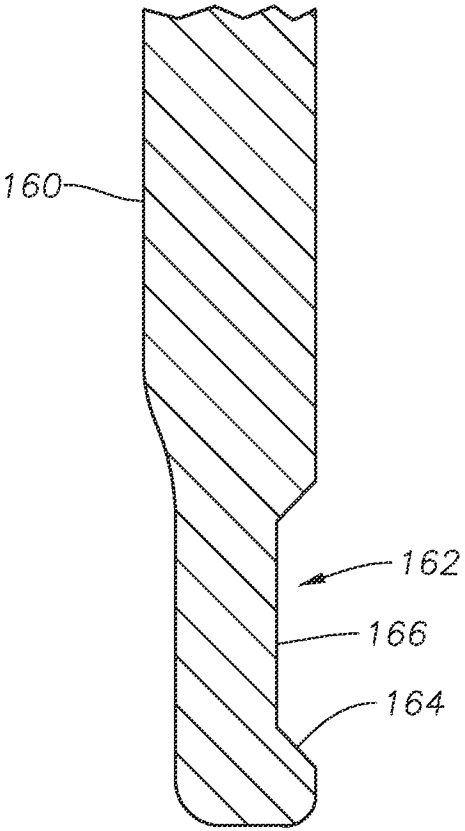
FIG. 4 is sectional side view of an energizing ring having an alternate recess profile, in accordance with the energizing ring divot backout lock of FIG. 1.

Referring to FIG. 4, the recess can have any of a variety of profiles. Energizing ring 160, for example, shows recess 162 having a trapezoid shaped profile such that shoulder 164 has a generally frusto-conical shape. Recess sidewall 166 can be generally perpendicular to the axis of energizing ring 160. In the event of a balloon-type deformation of a seal (not shown in FIG. 4) positioned adjacent to energizing ring 160, a portion of the seal can occupy recess 162 and engage shoulder 164 to prevent upward movement of energizing ring 160.

Figure 5:
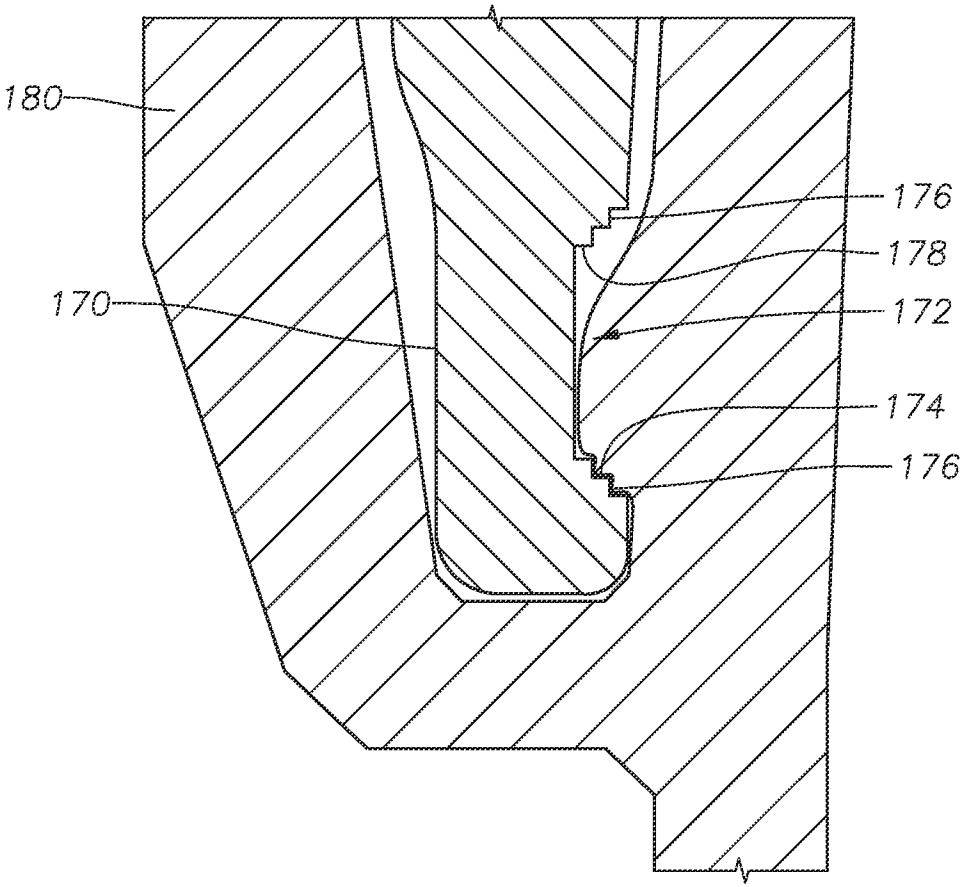
FIG. 5 is sectional side view of an energizing ring having another alternate recess profile, in accordance with the energizing ring divot backout lock of FIG. 1.

Referring to FIG. 5, energizing ring 170 can include recess 172 having a stepped profile. The stepped profile can include one or more upward facing shoulders 174 and one or more sidewalls 176 between each adjacent upward facing shoulder 174. Similarly, the upper portions of recess 172 can include one or more downward facing shoulders 178, each separated by sidewall 176. In the event of a balloon-type deformation of a seal 180, a portion of seal 180 can expand into recess 172 until a portion of seal 180 is vertically above or in contact with one or more of the upward facing shoulders 174. The portions of seal 180, thus, can prevent upward movement of energizing ring 170.

While the invention has been shown or described in only some of its forms, it should be apparent to those skilled in the art that it is not so limited, but is susceptible to various changes without departing from the scope of the invention.

What is claimed is:

1. A seal locking assembly for use with a wellhead assembly, comprising:

an annular seal having a leg that is selectively axially compressed from a first shape that is axially uncompressed to a second shape that is axially compressed;

a bulge that projects radially inward from the leg when the leg is in the second shape; and an energizing ring having a nose and a sidewall, selectively insertable into an annular space in the annular seal; and an annular recess located on the sidewall that receives the bulge.

2. The seal locking assembly according to claim 1, wherein when in the second shape a portion of the seal bulges into the recess and creates an interference lock between the seal and the energizing ring that prevents axial movement of the energizing ring relative to the annular seal in at least one axial direction.

3. The seal locking assembly according to claim 2, wherein the interference lock prevents axial movement of the energizing ring relative to the annular seal in both axial directions.

4. The seal locking assembly according to claim 1, wherein the leg comprises an inner leg, and wherein the annular seal comprises a u-shaped seal having the inner leg and an outer leg defining the space therebetween, and upon occupying the space, the energizing ring urges the inner and outer legs into sealing engagement with the sealing surface and with another sealing surface, respectively.

5. The seal locking assembly according to claim 1, wherein the annular recess comprises an outward and upward facing tapered surface.

6. The seal locking assembly according to claim 5, wherein the second shape of the annular seal engages the outward and upward facing tapered surface.

7. The seal locking assembly according to claim 1, wherein, once the annular seal has assumed the second shape, the energizing ring can be disengaged only by deformation of one of the energizing ring and the annular seal.

8. A wellhead assembly comprising:

an outer tubular wellhead member having an outer sealing surface;

an inner tubular wellhead member within the outer tubular wellhead member and having an inner sealing surface;

a seal pocket between the inner and outer tubular wellhead members;

an annular seal disposed within the seal pocket and that is axially compressible from a first shape to a deformed second shape that has a radially projecting bulge;

an annular energizing ring inserted into a space in the seal and having a sidewall and a nose on a lower end of the sidewall; and an annular recess located on the sidewall that receives the bulge when the seal is in the second shape for engaging the seal when the seal deforms.

9. The wellhead assembly according to claim 8, wherein the annular seal is deformable from the first shape to the second shape in response to upward movement of the inner tubular wellhead member, and the second shape creates an interference lock on the annular recess.

10. The wellhead assembly according to claim 8, wherein engagement between the recess and the deformed seal blocks upward movement of the energizing ring.

11. The wellhead assembly according to claim 8, wherein when the seal deforms, a portion of the seal protrudes into the recess.

12. The wellhead assembly according to claim 8, wherein the annular seal comprises a u-shaped seal having an inner leg and an outer leg defining a gap therebetween, and upon occupying the gap, the energizing ring urges the inner and outer legs into sealing engagement with the inner sealing surface and the outer sealing surface, respectively.

13. The wellhead assembly according to claim 8, wherein the annular recess comprises an outward and upward facing tapered surface.

14. The wellhead assembly according to claim 13, wherein the second shape of the annular seal engages the outward and upward facing tapered surface.

15. The wellhead assembly according to claim 14, wherein the energizing ring is restricted from upward movement when the annular seal engages the outward and upward facing tapered surface.

16. The wellhead assembly according to claim 8, wherein the interference lock is disengaged by deforming one of the energizing ring and the annular seal.

17. A method for forming a locking seal between two annular members, the method comprising:

providing an outer tubular wellhead member having an outer sealing surface and an inner tubular wellhead member adapted to land within the outer tubular wellhead member, defining a seal pocket between them, the inner tubular wellhead member having an inner sealing surface;

positioning an annular seal within the seal pocket; and deforming the seal by energizing the annular seal with an axial force from an energizing ring by urging at least a portion of the annular seal against one of the sealing surfaces, the energizing ring having that has annular recess located on the sidewall below a forcing surface, so that when the seal is deformed, a bulge forms on the seal and projects into the recess.

18. The method according to claim 17, further comprising the step of destructively deforming one of the annular seal and the energizing ring while withdrawing the energizing ring from the annular seal.

19. The method according to claim 17, wherein the annular seal is deformed in response to upward force exerted against the inner tubular wellhead member.

* * * * *